US006457192B2

(12) United States Patent
Choi et al.

(10) Patent No.: US 6,457,192 B2
(45) Date of Patent: Oct. 1, 2002

(54) AIR BED WITH ELEVATED AND SELF-EXPANDING SUPPORT STRUCTURE

(76) Inventors: Harrison Choi, Jinwoong Bldg., Yuhuadong Road, Huli Industrial Zone, Xiamen, Fujian (CN); Samuel F. Lamke, #9 Forest Hills Dr., Washington, MO (US) 63090

( * ) Notice: Subject to any disclaimer, the term of this patent is extended or adjusted under 35 U.S.C. 154(b) by 0 days.

(21) Appl. No.: 09/905,606

(22) Filed: Jul. 13, 2001

Related U.S. Application Data

(60) Provisional application No. 60/238,662, filed on Oct. 4, 2000, and provisional application No. 60/262,767, filed on Jan. 19, 2001.

(51) Int. Cl.[7] ..... A47C 17/64; A47C 19/12; A47C 27/08

(52) U.S. Cl. ..... 5/114; 5/112; 5/706

(58) Field of Search ..... 5/114, 112, 115, 5/116, 117, 174, 175, 176.1, 177, 181, 182, 184, 706, 710, 713, 644, 654, 655.3, 737, 738, 482, 496, 499, 659, 925, 926, 708

(56) References Cited

U.S. PATENT DOCUMENTS

| | | | | | |
|---|---|---|---|---|---|
| 1,185,568 | A | * | 5/1916 | Zeunert | 5/115 X |
| 1,317,235 | A | * | 9/1919 | Stonebridge | 5/706 |
| 1,382,531 | A | * | 6/1921 | Newborn | 5/706 |
| 2,253,801 | A | * | 8/1941 | Neal | 5/710 |
| 2,823,394 | A | * | 2/1958 | Smith | 5/738 X |
| 2,946,067 | A | * | 7/1960 | Wolshin | 5/706 X |
| 3,045,257 | A | * | 7/1962 | Knapp | 5/706 X |
| 3,784,994 | A | | 1/1974 | Kery | 5/348 |
| 3,790,975 | A | | 2/1974 | Philipp et al. | 5/349 |
| 3,798,686 | A | | 3/1974 | Gaiser | 5/343 |
| 3,877,092 | A | | 4/1975 | Gaiser | 5/343 |
| 3,959,835 | A | * | 6/1976 | Nos | 5/706 |
| 3,967,330 | A | * | 7/1976 | Zawadowsky | 5/114 |
| 4,025,974 | A | | 5/1977 | Lea et al. | 5/367 |
| 4,149,285 | A | | 4/1979 | Stanton | 5/347 |
| 4,169,295 | A | * | 10/1979 | Darling | 5/706 |
| 4,371,999 | A | | 2/1983 | Reid | 5/457 |
| 4,394,784 | A | | 7/1983 | Swenson et al. | 5/453 |
| 4,435,864 | A | | 3/1984 | Callaway | 5/453 |
| 4,442,556 | A | * | 4/1984 | Craigie | 5/13 |
| 4,594,743 | A | * | 6/1986 | Owen et al. | 5/112 X |
| 4,617,690 | A | | 10/1986 | Grebe | 5/453 |
| 4,644,597 | A | | 2/1987 | Walker | 5/449 |
| 4,694,515 | A | * | 9/1987 | Rogers, Jr. | 5/706 X |

(List continued on next page.)

FOREIGN PATENT DOCUMENTS

| | | | | |
|---|---|---|---|---|
| FR | 2554335 A1 | * | 5/1985 | 5/713 |
| IT | 329338 | * | 9/1935 | 5/117 |

*Primary Examiner*—Robert G. Santos
(74) *Attorney, Agent, or Firm*—Larry B. Guernsey; Intellectual Property Law Offices

(57) ABSTRACT

A collapsible bed (10) having an air mattress (14) and a support frame (18). The support frame (18) includes a number of frame members (32), which are joined by pivot assemblies (36), such that the support frame (18) as a whole expands outwardly from a central area (42), when a portion of the frame (18) is pulled outwardly.

A second preferred embodiment is a self-expanding bed (100) having an air mattress (14) and an articulated support frame (18), which as a whole expands outwardly from a central area (42). The air mattress (14) is attached to the support frame (18) at a number of points, so that when the air mattress (14)is inflated and expands outwardly, the support frame (18) also expands outwardly. An electric air pump (60) is preferably included which may be activated by a remote control (64), so that the bed (100) is self-expanding.

36 Claims, 6 Drawing Sheets

U.S. PATENT DOCUMENTS

| | | | | | |
|---|---|---|---|---|---|
| 4,803,744 | A | | 2/1989 | Peck et al. | 5/453 |
| 4,890,344 | A | * | 1/1990 | Walker | 5/713 |
| 4,896,389 | A | | 1/1990 | Chamberland | 5/453 |
| 4,897,890 | A | | 2/1990 | Walker | 5/453 |
| 4,949,413 | A | | 8/1990 | Goodwin | 5/453 |
| 4,977,633 | A | | 12/1990 | Chaffee | 5/453 |
| 4,991,244 | A | | 2/1991 | Walker | 5/400 |
| 5,020,176 | A | * | 6/1991 | Dotson | 5/713 X |
| 5,421,044 | A | | 6/1995 | Steensen | 5/453 |
| 5,509,154 | A | * | 4/1996 | Shafer et al. | 5/713 |
| 5,598,593 | A | | 2/1997 | Wolfe | 5/710 |
| 5,611,414 | A | | 3/1997 | Walker | 190/2 |
| 5,634,225 | A | | 6/1997 | Miller et al. | 5/710 |
| 5,652,484 | A | * | 7/1997 | Shafer et al. | 5/713 X |
| 5,848,450 | A | | 12/1998 | Oexman et al. | 5/713 |
| 5,903,941 | A | * | 5/1999 | Shafer et al. | 5/713 X |
| 5,975,626 | A | | 11/1999 | Ayocock | 297/16.1 |
| 6,037,723 | A | * | 3/2000 | Shafer et al. | 5/713 X |
| 6,058,537 | A | * | 5/2000 | Larson | 5/710 |
| 6,079,065 | A | | 6/2000 | Luff et al. | 5/618 |
| 6,108,843 | A | | 8/2000 | Suzuki et al. | 5/713 |
| 6,108,844 | A | | 8/2000 | Kraft et al. | 5/732 |
| 6,161,231 | A | | 12/2000 | Kraft et al. | 5/18.1 |
| 6,202,239 | B1 | * | 3/2001 | Ward et al. | 5/713 |
| 6,234,089 | B1 | | 5/2001 | Zheng et al. | 108/115 |
| 6,287,095 | B1 | * | 9/2001 | Saputo et al. | 5/708 X |
| 6,332,760 | B1 | * | 12/2001 | Chung | 5/706 X |

* cited by examiner

AIR BED WITH ELEVATED AND SELF-EXPANDING SUPPORT STRUCTURE

This application claims priority from U.S. Provisional Applications Ser. Nos. 60/238,662, filed Sep. 4, 2000, and 60/262,767, filed Jan 19, 2001.

TECHNICAL FIELD

The present invention relates generally to collapsible furniture, and more particularly to bedding which may be used for temporary purposes such as for overnight guests.

BACKGROUND ART

Temporary beds have been used for many years and come in many forms, from a simple futon or air mattress to more complex "hide-a-bed" style devices. Such temporary beds are most often used when guests, either expected or otherwise, stay overnight. In such cases, it is desirable that the temporary bed be quick and easy to assemble, comfortable, and collapse to a small configuration which can be easily and conveniently stored in a closet or storage cabinet. An air mattress has the advantage of deflating to a very compact size when the internal air pressure is released, and can be set up in a relatively short amount of time. The air pressure in the mattress gives good support to body members and the air can redistribute within the mattress slightly in response to greater weight loads in certain areas. It can thus conform to the user's body, is lightweight, and is generally easily portable, even when inflated.

However, air mattresses which are pitched on the floor of a dwelling, may be perceived as being less gracious than beds which are elevated from the floor. Elevated beds may have less intimate contact with floor dirt and grime, thus be more suitable for those with allergies or aversions to dirt. Furthermore, an elevated bed may be easier to get into and out of for those who may have trouble squatting on the floor, or for those with stiff joints or arthritis.

Additionally, those who go camping out of trailers, etc. may wish to sleep out-of-doors, but may wish to isolate themselves from insects, snakes and other forest denizens which may roam the forest floor. For such purposes, an elevated bed, which is easily collapsible and portable, may be very useful. It also may be useful in rocky terrain, or in areas of thorns or burrs, which would otherwise contact the air mattress and possibly puncture it.

Generally, the less effort involved in constructing the bed, the more desirable the typical user would consider the bed to be. People who are contemplating retiring to bed are often already in a state of fatigue or unsteadiness in which the construction of a bed from a collapsed configuration to an expanded configuration may seem a daunting prospect. Therefore, a bed structure which requires minimal involvement by the user in its construction, or, even better, is largely self-erecting, would be very desirable in a variety of situations.

Thus there is a need for a collapsible bed which is elevated from contact with the ground or floor, and which is both very portable and comfortable for the user. There is also a need for a bed which requires minimal involvement by the user in its construction, or, even better, is largely self-erecting.

DISCLOSURE OF INVENTION

Accordingly, it is an object of the present invention to provide a bed that is collapsible and portable.

Another object of the invention is to provide a bed which stores in a very small space.

And another object of the invention is to provide a bed which uses an air mattress which is elevated up off the floor.

A further object of the invention is to provide a bed which requires a minimum of human effort to construct from a collapsed configuration to an expanded one.

An additional object of the invention is to provide a self-expanding bed in which the self-erecting mechanism is operated by remote control.

Briefly, one preferred embodiment of the present invention is a collapsible bed having an air mattress and a support frame. The frame includes a number of frame members, which are joined by pivot assemblies, such that the support frame as a whole expands outwardly from a central area, when a portion of the frame is pulled outwardly.

A second preferred embodiment is a self-expanding bed having an air mattress and an articulated support frame. The frame includes a number of frame members, which are joined by pivot assemblies, such that the support frame as a whole expands outwardly from a central area. The air mattress is attached to the support frame at a number of points, so that when the air mattress is inflated and expands outwardly, the support frame also expands outwardly. An electric air pump may also be included, which may be activated by a remote control, so that the bed is self-expanding.

An advantage of the present invention is that it uses an external frame and independent air mattress.

Another advantage of the invention is that the air mattress can be replaced if damaged, without replacing the whole bed.

And another advantage of the invention is that the frame is constructed with permanently joined members connected with pivot joints so that the frame collapses and expands as a unit, and requires very little construction or hunting for lost pieces.

An additional advantage of the invention is that it contains an air-pump which can be activated by a remote control to cause the pump to fill the mattress. The force of the air in the mattress as it expands causes the frame structure to expand and move from its collapsed to its expanded configuration, with minimal, or no manual effort by the user.

These and other objects and advantages of the present invention will become clear to those skilled in the art in view of the description of the best presently known mode of carrying out the invention and the industrial applicability of the preferred embodiment as described herein and as illustrated in the several figures of the drawings.

BRIEF DESCRIPTION OF THE DRAWINGS

The purposes and advantages of the present invention will be apparent from the following detailed description in conjunction with the appended drawings in which.

BEST MODE FOR CARRYING OUT THE INVENTION

Figure 1:
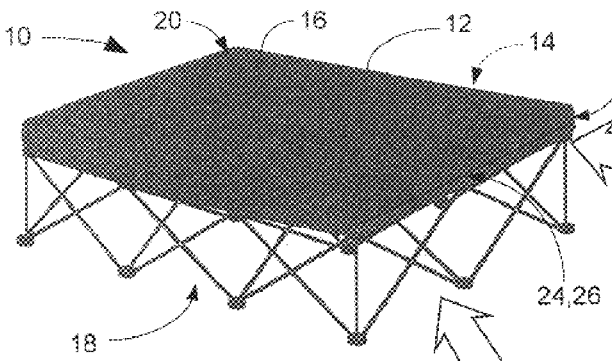
FIG. 1 is an isometric view of the air bed with elevated support structure used in the preferred embodiment of the present invention.

A preferred embodiment of the present invention is an air bed with a support structure. As illustrated in the various drawings herein, and particularly in the view of FIG. 1, a form of this preferred embodiment of the inventive device is depicted by the general reference character 10.

Figure 2:
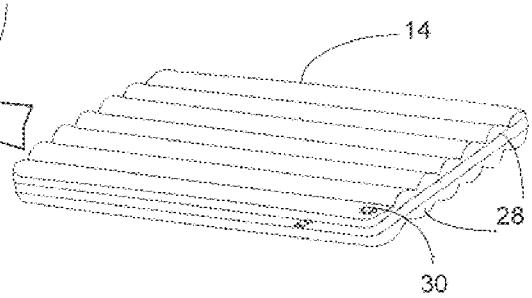
FIG. 2 is an isometric view of the air mattress used in the preferred embodiment of the present invention.
Figure 3:
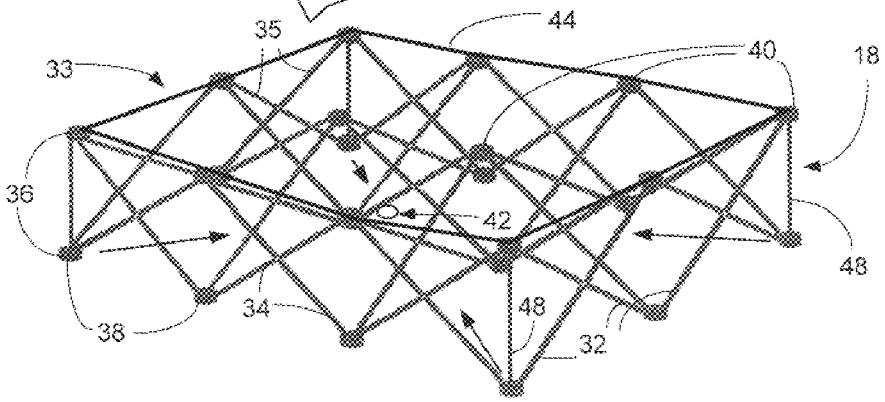
FIG. 3 is an isometric view of the frame structure used in the preferred embodiment of the present invention.

FIGS. 1–3 illustrates an air bed with an elevated support structure 10, having generally an air bed 12 which includes an air mattress 14 (not visible in FIG. 1) and a fabric covering 16, and a support frame 18. The fabric covering 16 includes generally a bag enclosure 20 having an entry mouth 22 which is sealed with a closure fastener 24, which is preferably a zipper 26, but which is also possibly any conventional device such as Velcro, hook-and-eye fasteners, etc. The fabric covering 16 can be plastic, cloth, leather, etc. and encloses at least a portion of the air mattress 14, shown in FIG. 2, which is inserted into the entry mouth 22, either before or after inflation. The zipper 26 is then closed to complete the installation of the air mattress 14. The air mattress 14 can also be removed as desired through the same entry mouth 22, again, either before or after the air mattress 14 is deflated. The air mattress 14 preferably has a number of cells 28 and at least one inflation port 30 through which air is introduced to inflate the air mattress 14. The fabric covering 16 need not completely enclose the entire air mattress, but may enclose only a portion or portions such as the ends or sides of the air mattress 14.

FIG. 3 shows the articulated support frame 18 which includes a number of frame members 32 which are attached to each other at pivots 34, some of which are positioned at the midpoints of the frame members 32, and some of which are included in pivot assemblies 36 in the feet 38 and upper connector assemblies 40. These pivot assemblies 36 and pivots 34 connect all the frame members 32 to each other, so there are no loose pieces to be gathered and assembled. The frame can be thought of as an extended scissors-frame assembly 33 since the tops and bottoms of each pair of frame members 32 scissor together or apart. These scissor pairs 35 are then joined in an extended assembly where the ends of multiple pairs 35 are joined at the pivot assemblies 36. They also allow the frame 18 as a whole to be collapsed or expanded in a very easy and efficient manner. Force directed at any one of the comers causes movement in all the other comers, so that there is movement of the whole frame in either an inward or outward direction, relative to a central area. The pivots 34 allow the frame structure 18 to move towards a central area 42 from all sides as a unit when the frame 18 is to be collapsed, and to move away from this central area 42 when expanding.

This configuration will be spoken of as "expanding outwardly from a central area", although it is to be understood that one of the feet may actually remain in fixed position, while the remainder of the feet move outward. In other words, the central reference area from which the feet move, may itself move laterally. One example of this occurs when the collapsed support frame is placed in the comer of a room, where, say, the left rear foot of the frame is in the left rear comer of the room, and thus is constrained from movement in a further leftward or rearward direction. When the frame expands, all the other, non-constrained feet will expand outwardly from a central area to the right, or forward, or both, even as the central area itself will move to the right and forward, relative to the immobile left rear foot.

It should also be understood that all the lines of direction of the movement of the feet are not expected to intersect at a precise point. The central area 42 is thus a relatively small region from which the feet 38 move outwardly, but there should be no inference that all feet must move in a specific lines, such as radially from a single specific center point. To one skilled in the art, it will be apparent that if such precise directionality were attempted, manufacturing errors would inevitably introduce variations. Thus, the expansion is considered to move outwardly from a central area or region, and should not be construed to imply any particular lines of direction, other than generally outward from this central area. The direction arrows and central area 42 shown in FIG. 3, and later in FIGS. 12 and 13 below, are therefore not provided to show specific lines of movement which must be followed, but merely a general direction of movement towards, or away from, a general central area 42.

The articulated frame 18 also optionally includes support webbing 44, which may have hooks (not shown) which anchor the support webbing to the frame members 32 and/or the upper connector assemblies 40, and may also have attachment points (not shown) for securing the fabric covering 16 to the webbing 44 and thus to the frame 18.

Figure 4:
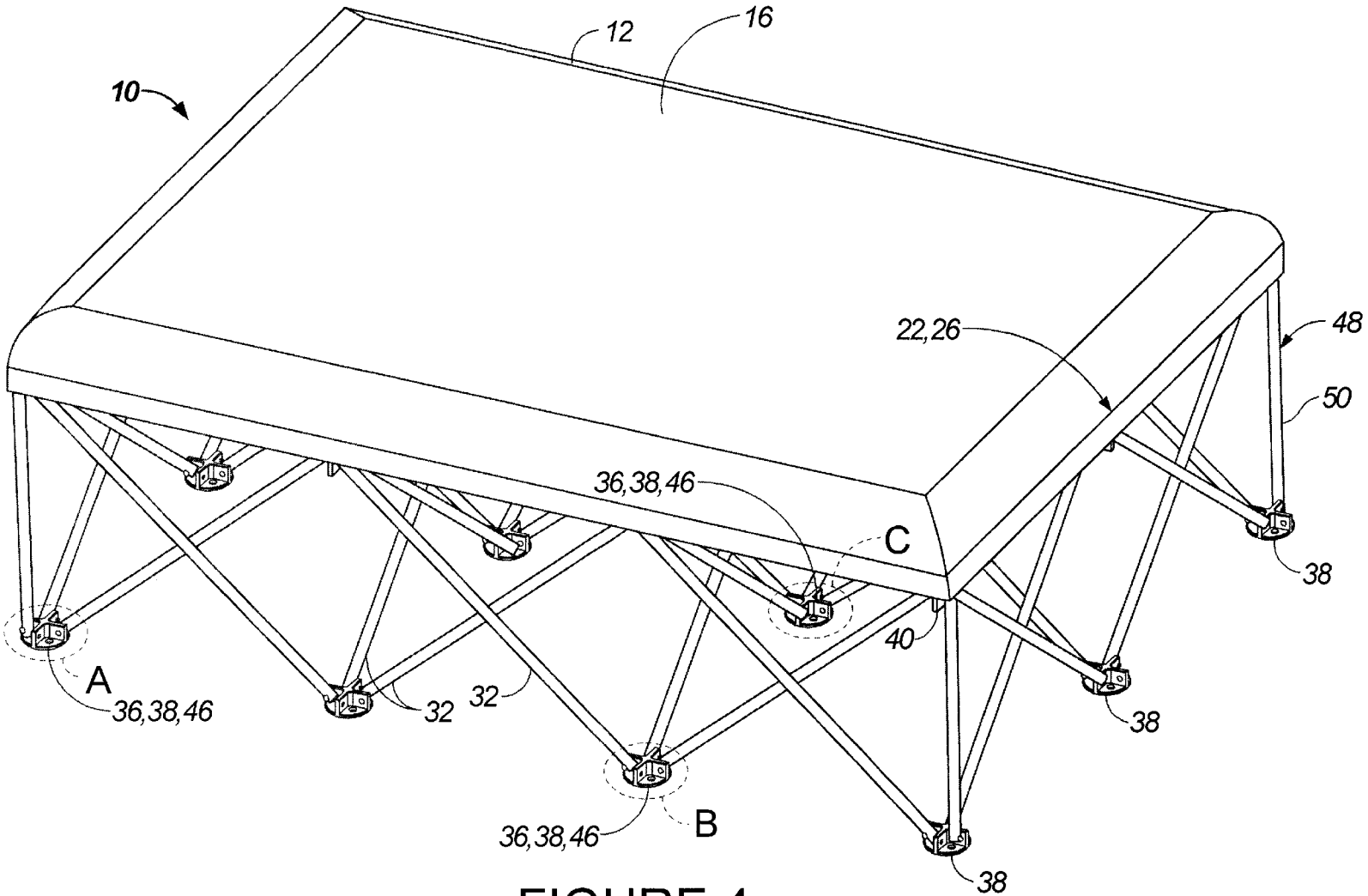
FIG. 4 is a top isometric view of the air bed with elevated support structure of the present invention.
Figure 5:
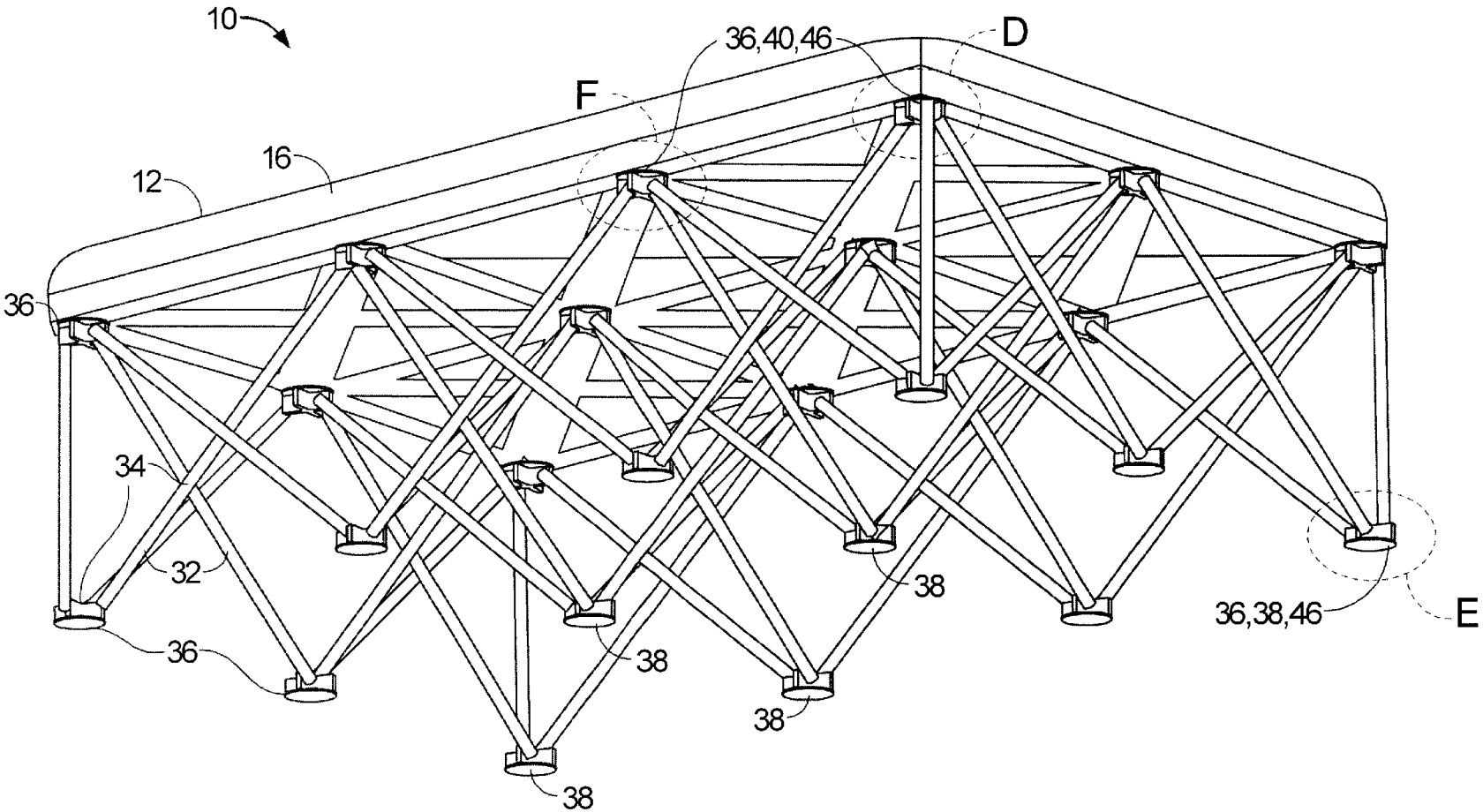
FIG. 5 is a bottom isometric view of the air bed with elevated support structure of the present invention.
Figure 10:
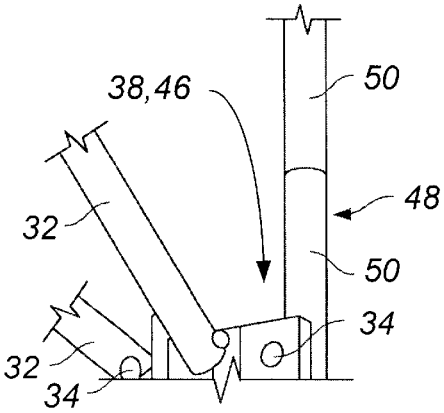
FIG. 10 is a detail view of the pivot assembly seen in detail circle E of FIG. 5.

FIGS. 4 and 5 show closer views of the assembled air bed 10 in which several of the pivot assemblies 36 are selected for detail views in detail circles A–F. The pivot assemblies 36 of the feet 38 and the upper connector assemblies 40 in this embodiment are made to receive 4 connections and thus will be called four-pivot connectors 46. These are preferably reversible, so that the same four-pivot connector 46 can be used as a foot 38 and as an upper connector assembly 40, thus making for uniformity, and ease of manufacturing. The frame members 32 too are preferably interchangeable and of uniform length, with the exception of the comer uprights 48, which are positioned in each of the four comers. These are composed of two or more comer members 50, which may slide within each other in order to extend or contract in length. This is desirable because when the frame 18 is in collapsed position, the comer uprights 48 must be of greater length than when the frame 18 is expanded. In the expanded position therefore, one of the comer members will preferably slide within the other, as shown in FIGS. 6 and 10 below.

Figure 6:
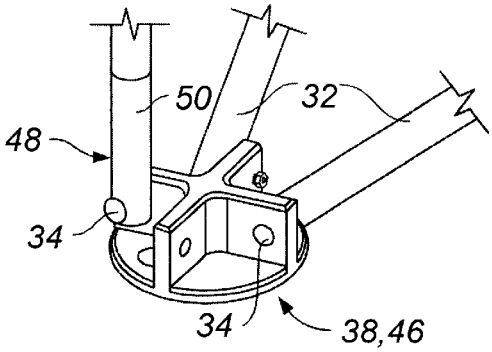
FIG. 6 is a detail view of the pivot assembly seen in detail circle A of FIG. 4.

FIG. 6 illustrates a foot 38, a type of four-pivot connector 46, which is seen in detail circle A of FIG. 4. Frame members 32, pivots 34, and comer upright 48 and its included comer members 50 are shown.

Figure 7:
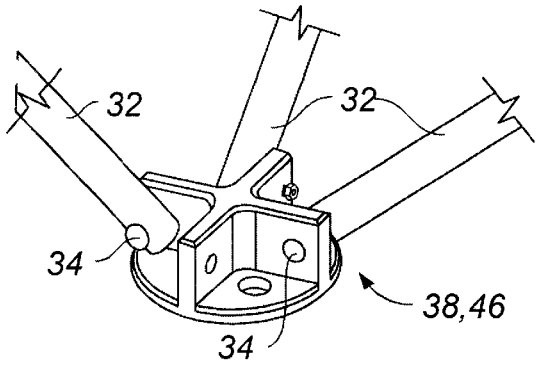
FIG. 7 is a detail view of the pivot assembly seen in detail circle B of FIG. 4.

FIG. 7 shows a foot 38, a type of four-pivot connector 46, which is seen in detail circle B of FIG. 4. Frame members 32, and pivots 34 are also shown.

Figure 8:
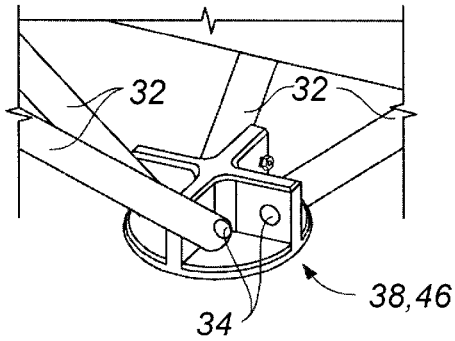
FIG. 8 is a detail view of the pivot assembly seen in detail circle C of FIG. 4.

FIG. 8 illustrates a foot 38, a type of four-pivot connector 46, which is seen in detail circle C of FIG. 4. Frame members 32, and pivots 34 are shown.

Figure 9:
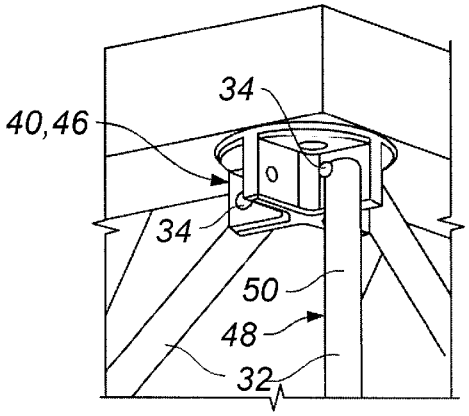
FIG. 9 is a detail view of the pivot assembly seen in detail circle D of FIG. 5.

FIG. 9 shows an upper connector assembly 40, a type of four-pivot connector 46, which is seen in detail circle D of FIG. 5. Frame members 32, comer upright 48 and its included comer member 50 are also shown.

FIG. 10 illustrates a foot 38, a type of four-pivot connector 46, which is seen in detail circle E of FIG. 5. Frame members 32, comer upright 48, pivots 34 and its included comer members 50 are shown.

Figure 11:
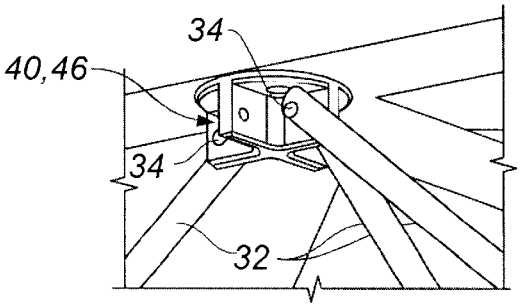
FIG. 11 is a detail view of the pivot assembly seen in detail circle F of FIG. 5.

FIG. 11 shows an upper connector assembly 40, a type of four-pivot connector 46, which is seen in detail circle F of FIG. 5. Frame members 32, and pivots 34 are also shown. Referring now also to FIGS. 1 and 2, thus the assembly sequence allows for the support frame 18 to be placed upright, expanded, the fabric covering 16 attached to the frame 18 and the air mattress 14 inserted into the entry mouth 22 of the bag enclosure 20, and the fastener 24 closed, and the bed is ready to receive bed clothes, or be otherwise used.

Figure 12:
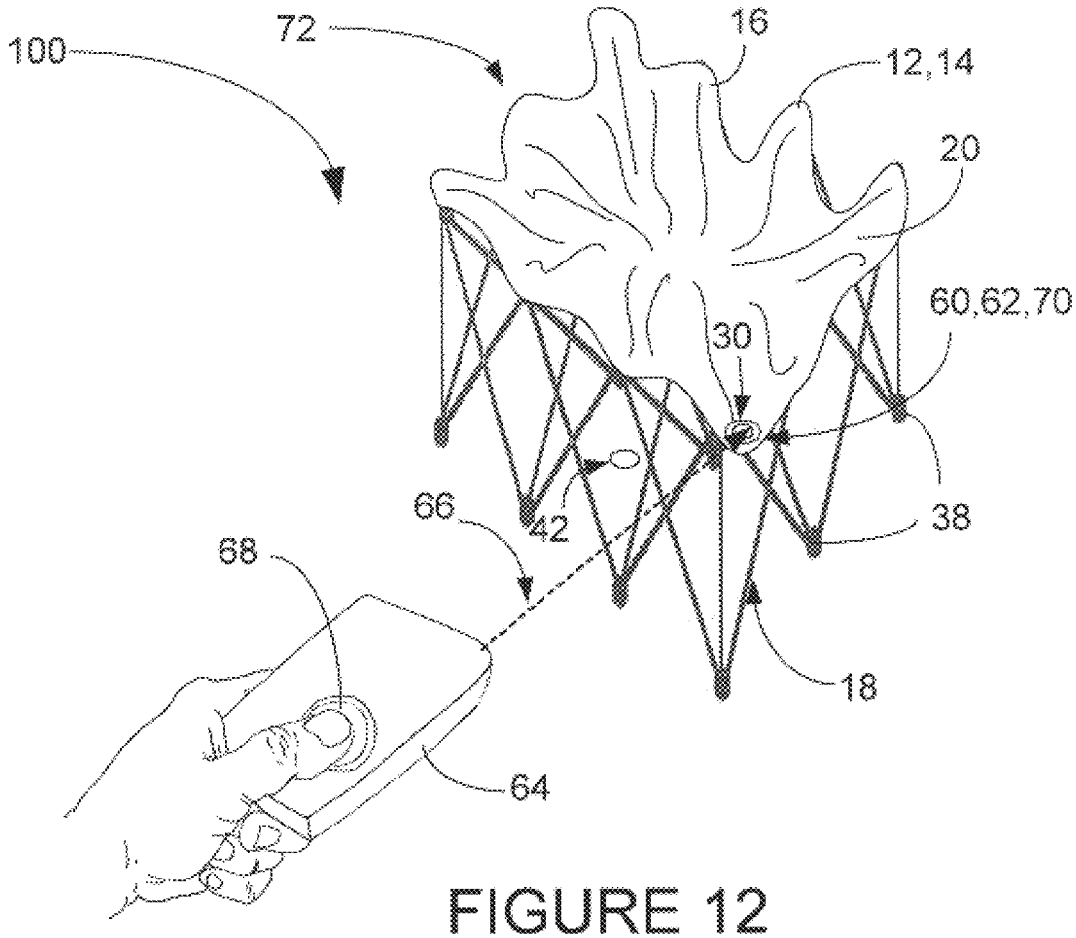
FIG. 12 is an isometric view of a self-expanding bed and frame, which is in a collapsed configuration.
Figure 13:
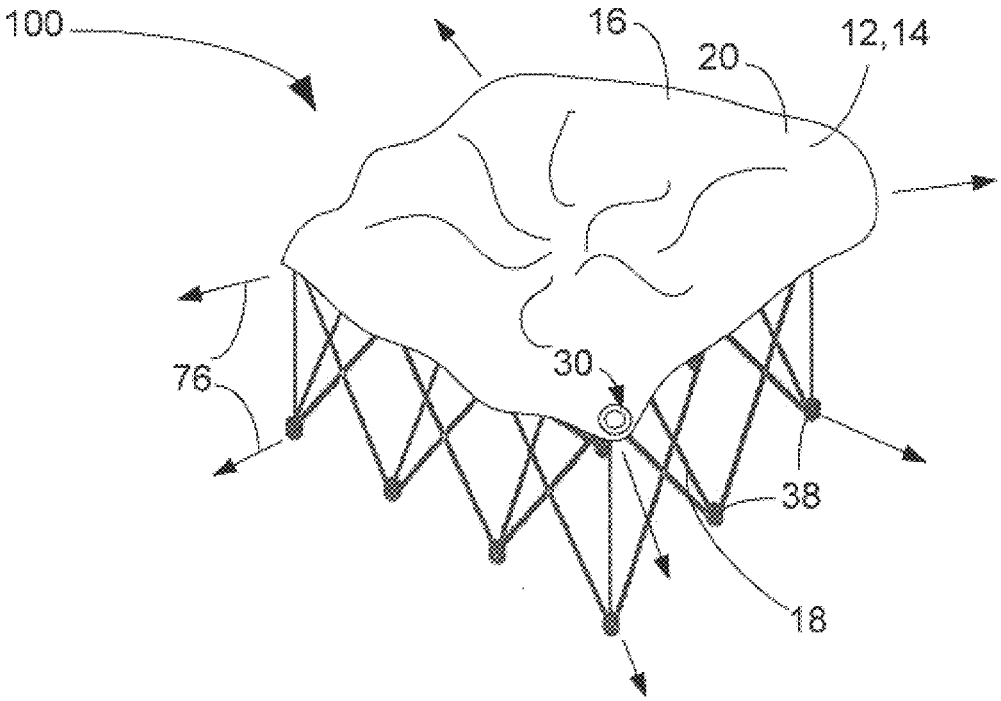
FIG. 13 is an isometric view of a self-expanding bed and frame, which is in transition from a collapsed to an expanded configuration.

A useful variation on this invention is an air-bed with a self-expanding support structure. This is shown in FIG. 12 as element 100. The structure and elements are much the same, and when elements correspond to those used previously, the same element numbers will be used.

The air-bed 12 with air mattress 14 is attached to a support frame 18, either directly, or preferably through a bag enclosure 20. The attachment may be permanent or removable, by such conventional means as buttons, snaps, Velcro®, etc., but it is important that the air mattress 14, as it expands, is attached at multiple points to the frame 18, so that the frame 18 is urged to move with the expansion of the air mattress 14, as discussed below. There is a fabric covering 16 as described previously, which may also be the bag enclosure 20, which protects the air mattress 14 from damage at points where it is rubbed against the frame structure 18 while inflating or deflating.

An air pump 60 is connected to an inflation port 30. The air pump 60 is electrically operated, and can be powered either by wall current or by batteries. If batteries are used, they may be included in a battery pack (not shown). The air pump 60 preferably includes a sensor 62, which can be operated by a beam 66 or communicating means from a remote control 64. The beam 66 or communicating means is preferably cordless, such as radio or infra-red diode laser beam, etc. The remote control 64 preferably has an on-off button 68, which activates and deactivates the electric pump 60. This remote control 64 is by no means a necessity, and the air pump 60 will preferably have a manual on-off switch 70 for back-up operation if the remote 64 is misplaced or the remote's batteries are low, or if the bed 100 is designed not to be operated by remote control at all.

In operation, the bed 100 will be assumed to start in a collapsed configuration 72, as in FIG. 12. The mattress 14 is squeezed together and is generally surrounded by the support frame 18, the frame 18 previously having been drawn together towards the central area 42, discussed above. The frame 18 is set upon its feet 38, and the air pump 60 is activated, either by operation of a manual on-off switch, or by pressing the button 68 on a remote control 64. The air pump 60 begins filling the air mattress 14 which then begins to expand generally out from the central area 42, as indicated by the direction arrows 76 in FIG. 13. As the mattress 14 expands it presses on the members of the frame 18, which pushes them also in the direction away from the central area 42. The feet 38 may be optionally fitted with low friction pads which can thus slide across floor surfaces, or may also be fitted with wheels to allow the frame 18 to expand easily and without hindrance.

The air pump 60 may be permanently attached to the mattress 14, or it may be removable in order to allow access to the inflation port 30 by either a hand pump or by mouth in case electrical power is unavailable for the electrical pump 60, or if it breaks down.

Figure 14:
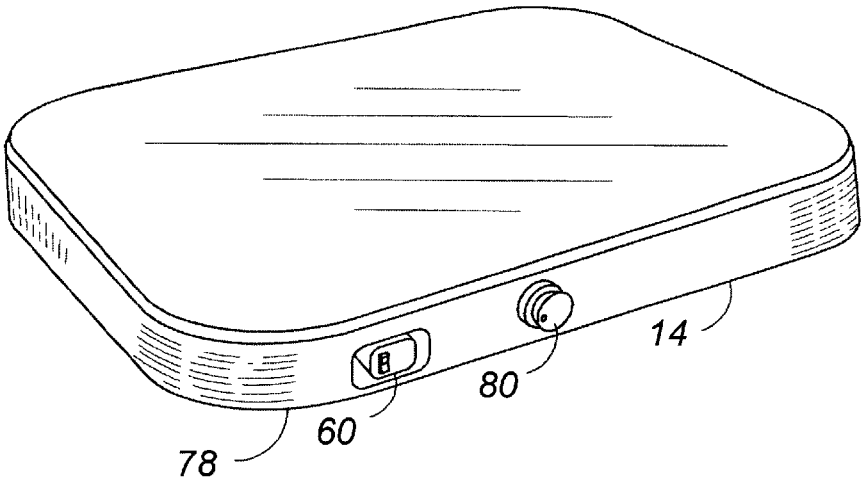
FIG. 14 shows an isometric view of the air mattress of the present invention.
Figure 15:
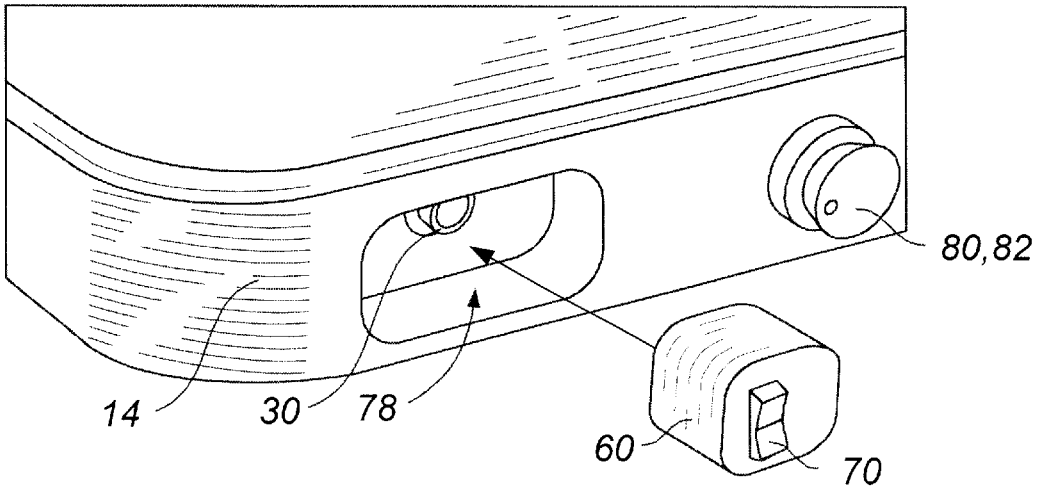
FIG. 15 is a detail view of the corner of the air mattress containing a pump and inflation port.

FIG. 14 shows an isometric view of an air mattress 14 and air pump 60 which has been attached to the inflation port 30 of the air mattress 14. FIG. 15 shows a detail view of the inflation port 30 from which the air pump 60 has been removed. Referring to both FIGS. 14 and 15, the air mattress 14 preferably has a recess area 78 into which the inflation port 30 has been seated. This recess area 78 allows the air pump 60 to fit smoothly without extending far beyond the perimeter of the mattress 14, thus protecting it from being bumped or knocked away from its position at the inflation port 30. Thus, the air pump 60 can be maintained in position after the inflation is complete. Of course, the use of a recess area is optional and should not be considered as a limitation. Also, the air pump 60 may be made to be routinely removed after operation. In this case a self-sealing valve (not shown) is provided for the air mattress 14. A manual on-off switch 70 is also shown, which is preferably included even when the pump 60 is expected to be operated by remote control.

Another optional feature is a secondary inflation port 80, which may be used for attachment of a manual air pump or for inflation by lung power. This may be a conventional air valve as generally used in air mattresses. It may also be used as a venting port 82 for allowing air pressure out of the mattress 14 if the air pump 60 is to be maintained in position, perhaps permanently.

The preferred embodiment 100 of this invention uses an air pump 60 which is removable. The air pump 60 and inflation port 30 are preferably fitting with a friction lock (not visible) similar to those used to attach lens to cameras, and which forms an airtight seal between the two parts.

The pump 60 also preferably contains a pressure sensor or self-regulator (not visible) which detects or acts when the air pressure in the mattress 14 has reached a predetermined level, and which then shuts off the air pump 60. This is also not a required feature and should not be construed as a limitation.

As mentioned above, the electrical air pump 60 may be operated from batteries, perhaps from a battery pack. The bed 100 is thus usable in the outdoors or in a cabin which is not equipped with power lines.

While various embodiments have been described above, it should be understood that they have been presented by way of example only, and not limitation. Thus, the breadth and scope of a preferred embodiment should not be limited by any of the above described exemplary embodiments, but should be defined only in accordance with the following claims and their equivalents.

INDUSTRIAL APPLICABILITY

The embodiments of the present invention 10, 100 present an easy and attractive way of providing bedding for overnight guests or visitors. The articulated support frame 18 which includes a number of frame members 32 which are attached to each other at pivots 34, which are positioned at the midpoints of the frame members 32 and at pivot assemblies 36 in the feet 38 and upper connector assemblies 40. These pivot assemblies 36 and pivots 34 connect all the frame members 32 to each other, so there are no loose pieces to be gathered and assembled. They also allow the frame 18 as a whole to be collapsed or expanded in a very easy and efficient manner. Force directed at any one of the corners causes movement in all the other corners, so that there is movement of the whole frame in either an inward or outward direction, relative to a central area 42. The pivots 34 allow the frame structure 18 to move towards a central area 42 from all sides as a unit when the frame 18 is to be collapsed, and to move away from this central area 42 when expanding.

In operation, the bed 10, 100 will be assumed to start in a collapsed configuration 72. The mattress 14 is squeezed together and is generally surrounded by the support frame 18, the frame 18 previously having been drawn together towards the central area 42, discussed above. The air mattress 14 is preferably attached to the frame 18 at multiple points, either directly, or by being at least partially enclosed by a fabric covering 16 which is, in turn, attached at multiple points to the frame 18. The frame 18 is set upon its feet 38, and inflated, either by the user's lung power or by activation of an electric pump 60. If the preferred air pump 60 is used, it is activated, either by operation of a manual on-off switch, or by pressing the button 68 on a remote control 64. The air pump 60 begins filling the air mattress 14 which then begins to expand generally out from the central area 42. As the mattress 14 expands it presses laterally on the members of the frame 18, which pushes them also in the direction away from the central area 42. The feet 38 may be optionally fitted with low friction pads which can thus slide across floor surfaces, or may also be fitted with wheels to allow the frame 18 to expand easily and without hindrance.

The present invention 10, 100 will find much application in user's homes, in commercial travel lodges, such as hotels, etc. where an extra bed may be needed, and may also find use in business offices to replace the occasional folding cot presently used by workaholics.

For the above, and other, reasons, it is expected that the air bed with elevated and self-expanding support structure 10, 100 of the present invention will have widespread industrial applicability. Therefore, it is expected that the commercial utility of the present invention will be extensive and long lasting.

What is claimed is:

1. A collapsible bed comprising:

an air mattress; and a support frame, including a plurality of frame members, each frame member having an upper end and a lower end, said upper ends of said frame members being pivotally attached to upper connector assemblies, and said lower ends being pivotally attached to feet, such that said feet move laterally within a common horizontal plane as the support frame as a whole moves from a collapsed configuration to an expanded configuration.

2. The collapsible bed of claim 1, wherein:

said air mattress is attached to said support frame at a plurality of points, so that when said air mattress is inflated and expands outwardly, said support frame also expands outwardly.

3. The collapsible bed of claim 1, further comprising:

a fabric covering, which encloses a portion of said air mattress, said fabric covering being attached to said support frame at a plurality of points, so that when said air mattress is inflated and expands outwardly, said fabric covering expands outwardly, causing said support frame to also expand outwardly.

4. The collapsible bed of claim 1, further comprising:

support webbing positioned between said air mattress and said support frame.

5. The collapsible bed of claim 2, wherein:

said air mattress is releasably attached.

6. The collapsible bed of claim 3, wherein:

said fabric covering is releasably attached.

7. The collapsible bed of claim 1, further comprising:

an electric pump, which pumps air at higher than ambient pressure into said air mattress.

8. The collapsible bed of claim 7, wherein:

said electric pump is remote controlled.

9. The collapsible bed of claim 7, further comprising:

a pressure sensor, which serves to deactivate said electric pump when a predetermined pressure level of air within said mattress has been reached.

10. The collapsible bed of claim 7, wherein:

said electric pump is detachably secured to said air mattress.

11. The collapsible bed of claim 1, wherein:

said frame members include said feet at their lower ends, and further comprising low friction devices attached to the lower ends of said frame members to allow the frame to expand easily and with minimal frictional opposition.

12. The collapsible bed of claim 11, wherein:

said low friction devices are chosen from a group consisting of low friction pads and wheels.

13. The collapsible bed of claim 1, further comprising:

primary and secondary inflation ports.

14. A collapsible bed comprising:

an air mattress;

a support frame, including a plurality of frame members, each frame member having an upper end and a lower end, said upper ends of said frame members being pivotally attached to upper connector assemblies, and said lower ends being pivotally attached to feet, such that the support frame as a whole expands outwardly from a central area; and comer uprights to support comers of said support frame, said comer uprights including comer members which extend vertically when said support frame is collapsed toward said central area.

15. The collapsible bed of claim 14, wherein:

said comer members slide one within the other in telescoping fashion in order to extend vertically, as the collapsible bed moves from expanded to collapsed configuration.

16. A self-expanding bed comprising:

an air mattress;

an articulated support frame, including a plurality of frame members, said frame members being joined at their lower ends to feet by pivot assemblies, such that said feet move laterally within a common horizontal plane as the support frame as a whole expands outwardly from a central area; and said air mattress is attached to said support frame at a plurality of points, so that when said air mattress is inflated and expands, said support frame also expands.

17. The self-expanding bed of claim 16, wherein:

said air mattress is attached to said support frame through use of a fabric covering, which encloses a portion of said air mattress, said fabric covering being attached to said support frame at a plurality of points, so that when said air mattress is inflated and expands outwardly, said fabric covering expands outwardly, causing said support frame to also expand outwardly.

18. The self-expanding bed of claim 17, wherein:

said fabric covering is releasably attached.

19. The self-expanding bed of claim 16, further comprising:

support webbing positioned between said air mattress and said support frame.

20. The self-expanding bed of claim 16, further comprising:

an electric pump, which pumps air at higher than ambient pressure into said air mattress.

21. The self-expanding bed of claim 20, wherein:

said electric pump is remote controlled.

22. The self-expanding bed of claim 20, further comprising:

a pressure sensor, which serves to deactivate said electric pump when a predetermined pressure level of air within said mattress has been reached.

23. The self-expanding bed of claim 20, wherein:

said electric pump is detachably secured to said air mattress.

24. The self-expanding bed of claim 16, wherein:

said frame members include feet at their lower ends, and further comprising low friction devices attached to the lower ends of said frame members to allow the frame to expand easily and with minimal frictional opposition.

25. The self-expanding bed of claim 16, wherein said support frame further comprises:

comer uprights to support comers of said support frame, said comer uprights including comer members which extend vertically as said support frame is collapsed toward said central area.

26. A self-expanding bed comprising:

an air mattress;

an articulated support frame, including a plurality of frame members, each frame member having an upper end and a lower end, said upper ends of said frame members being pivotally attached to upper connector assemblies, and said lower ends being pivotally attached to feet, such that said feet move laterally within a common horizontal plane as the support frame as a whole expands outwardly from a central area;

a fabric covering, which encloses a portion of said air mattress, said fabric covering being attached to said support frame at a plurality of points, so that when said air mattress is inflated and expands, said fabric covering expands, causing said support frame to also expand;

support webbing positioned between said air mattress and said support frame: and said frame members include said feet at their lower ends, and further comprising low friction devices attached to the lower ends of said frame members to allow the frame to expand easily and with minimal frictional opposition.

27. The self-expanding bed of claim 26, wherein said support frame further comprises:

corner uprights to support comers of said support frame, said comer uprights including comer members which extend vertically as said support frame is collapsed toward said central area.

28. A method of installing a collapsible bed, comprising the steps of:

A) providing a collapsible bed having an air mattress and a support frame, said support frame including a plurality of frame members, said frame members being joined by pivot assemblies, such that said feet move laterally within a common horizontal plane as the support frame as a whole expands outwardly from a central area; and B) expanding said collapsible bed outwardly from said central area.

29. The method of installing a collapsible bed of claim 28, wherein step B includes:

a) grasping said support frame at some point and pulling outward from said central area, thus causing said support frame to expand outwardly as a whole from said central area; and b) inflating said air mattress.

30. The method of installing a collapsible bed of claim 28, wherein said air mattress is attached to said support frame at a plurality of points, so that when said air mattress is inflated and expands outwardly, said support frame also expands outwardly, wherein step B includes:

a) introducing air at pressure higher than ambient pressure into said air mattress thus causing air mattress to inflate and expand outwardly, causing said attached support frame to expand outwardly as a whole from said central area.

31. The method of installing a collapsible bed of claim 30, wherein:

said air at higher than ambient pressure is introduced by an electric pump.

32. The method of installing a collapsible bed of claim 31, wherein:

said electric pump is remote controlled.

33. The method of installing a collapsible bed of claim 30, wherein:

said air mattress is attached to said support frame through use of a fabric covering, which encloses a portion of said air mattress, said fabric covering being attached to said support frame at a plurality of points, so that when said air mattress is inflated and expands outwardly, said fabric covering expands outwardly, causing said support frame to also expand outwardly.

34. A collapsible bed comprising:

an air mattress; and a support frame, including a plurality of frame members, each frame member having an upper end and a lower end, said upper ends of said frame members being pivotally attached to upper connector assemblies, and said lower ends being pivotally attached to feet, such that the support frame forms an extended scissor frame assembly which as a whole expands outwardly from a central area.

35. A collapsible bed comprising:

an air mattress; and a support frame, including a plurality of frame members, each frame member having an upper end and a lower end, said upper ends of said frame members being pivotally attached to upper connector assemblies, and said lower ends being pivotally attached to feet, such that the support frame as a whole expands radially outwardly from a central area.

36. A collapsible bed comprising:

an air mattress; and a support frame, including a plurality of frame members, each frame member having an upper end and a lower end, said upper ends of said frame members being pivotally attached to upper connector assemblies, and said lower ends being pivotally attached to feet, such that said feet remain in contact with a contact surface as the support frame as a whole moves from a collapsed configuration to an expanded configuration.

* * * * *

UNITED STATES PATENT AND TRADEMARK OFFICE

CERTIFICATE OF CORRECTION

PATENT NO. : 6,457,192 B2
DATED : October 1, 2002
INVENTOR(S) : Harrison Choi and Samuel F. Lamke It is certified that error appears in the above-identified patent and that said Letters Patent is hereby corrected as shown below:

Column 4,
Lines 1, 2 and 56, replace “comers” with -- corners --;
Lines 55, 57, 60, 62 and 67, replace “comer” with -- corner --;

Column 5,
Lines 9 and 10, replace “comer” with -- corner --;

Column 8,
Lines 40 and 41, replace “comer” with -- corner -- and “comers” with -- corners --;
Line 45, replace “comer” with -- corner --;

Column 9,
Lines 28, replace “comer” with -- corner -- and “comers” with -- corners --;
Lines 29 and 57, replace “comer” with -- corner -- and “comer” with -- corner --;
Line 56, replace “comers” with -- corners --.

Signed and Sealed this

Twenty-fifth Day of March, 2003

JAMES E. ROGAN
*Director of the United States Patent and Trademark Office*